US009850609B2

(12) United States Patent
Kambara et al.

(10) Patent No.: US 9,850,609 B2
(45) Date of Patent: Dec. 26, 2017

(54) OUTER SHUTTLE OF SEWING MACHINE

(71) Applicant: JANOME SEWING MACHINE CO., LTD., Hachioji-shi, Tokyo (JP)

(72) Inventors: Hideaki Kambara, Hachioji (JP); Yasuhiro Osanai, Hachioji (JP); Yasuhiko Komiya, Hachioji (JP)

(73) Assignee: JANOME SEWING MACHINE CO., LTD, Hachioji-Shi, Tokyo (JP)

( * ) Notice: Subject to any disclaimer, the term of this patent is extended or adjusted under 35 U.S.C. 154(b) by 0 days.

(21) Appl. No.: 15/055,396

(22) Filed: Feb. 26, 2016

(65) Prior Publication Data

US 2016/0289878 A1 Oct. 6, 2016

(30) Foreign Application Priority Data

Mar. 30, 2015 (JP) ..... 2015-069494

(51) Int. Cl.
*D05B 57/16* (2006.01)
*D05B 57/26* (2006.01)

(52) U.S. Cl.
CPC ..... *D05B 57/16* (2013.01); *D05B 57/26* (2013.01)

(58) Field of Classification Search
CPC ..... D05B 57/00–57/38
See application file for complete search history.

(56) References Cited

U.S. PATENT DOCUMENTS

| | | | | |
|---|---|---|---|---|
| 523,334 | A | * | 7/1894 | Diehl |
| 3,390,653 | A | * | 7/1968 | Ketterer |
| 4,326,474 | A | * | 4/1982 | Zylbert |
| 4,389,955 | A | * | 6/1983 | Larsen |
| 4,660,487 | A | * | 4/1987 | Mikuni |
| 7,171,914 | B2 | * | 2/2007 | Ota |

FOREIGN PATENT DOCUMENTS

JP 3054640 U 12/1998

* cited by examiner

*Primary Examiner* — Ismael Izaguirre
(74) *Attorney, Agent, or Firm* — McGinn IP Law Group, PLLC.

(57) ABSTRACT

An outer shuttle of a sewing machine, which accommodates an inner shuttle that grabs an upper thread and accommodates a bobbin around which a lower thread is wound, includes: a gear shaft which has a driven gear connected to a driving gear, provided on a lower shaft, which is a driving source of the outer shuttle that is rotatably supported in the sewing machine, and which also has a shaft support hole formed aligned with an axial center of the driven gear; a shuttle body to which the gear shaft is press-fitted and fixed at the center of rotation of a press-fit receiving hole formed in a bottom portion thereof; and a shuttle supporting shaft which is inserted into the shaft support hole of the gear shaft of the shuttle body to support the rotation of the shuttle body.

8 Claims, 4 Drawing Sheets

OUTER SHUTTLE OF SEWING MACHINE

BACKGROUND OF THE INVENTION

1. Field of the Invention

The present invention relates to an outer shuttle of a sewing machine, having a structure such that the outer shuttle accommodates an inner shuttle that grabs an upper thread and accommodates a bobbin around which a lower thread is wound, and a gear shaft having a driven gear connected to a driving gear provided on a lower shaft of a driving source that is rotatably supported in the sewing machine is fixed by press-fitting to a shuttle body.

2. Description of the Related Art

General sewing machines are provided with a shuttle device including an outer shuttle having a cutting edge for grabbing an upper thread and an inner shuttle that accommodates a bobbin around which a lower thread is wound in order to form stitches using the upper thread and the lower thread wound around the bobbin. A gear shaft is attached to a lower end surface of the outer shuttle, and the outer shuttle is rotated by a driving gear that is attached to a lower shaft of the sewing machine to engage with the gear shaft. An outer shuttle in which the shuttle body and the gear shaft are formed of separate members is known. An outer shuttle of this type is disclosed in Japanese Utility Model Registration No. 3054640, for example.

The shuttle body and the gear shaft are formed of separate members when the two members are formed of different materials and it is difficult to form the same integrally. This is the case where the shuttle body is formed of metal and the gear shaft is formed of a synthetic resin, for example. When constituent elements of a shuttle are formed of separate members and different materials, the manufacturing cost may be decreased. Thus, a shuttle device of a type such that the shuttle body and the gear shaft are formed of separate members may be used depending on the grade of a sewing machine. FIGS. 4A and 4B are schematic views for describing the outer shuttle disclosed in Japanese Utility Model Registration No. 3054640.

SUMMARY OF THE INVENTION

In the conventional technique disclosed in Japanese Utility Model Registration No. 3054640, a shuttle device of a type such that the shuttle body and the gear shaft of an outer shuttle are formed of separate members has the following problems. That is, a gear shaft a is attached to a bottom portion of a shuttle body b, a driving gear provided in the sewing machine engages with the gear shaft, the driving gear rotates with the driving of a motor, and the rotation is transmitted to the gear shaft a to rotate the shuttle body b.

The gear shaft a is hollow and a supporting shaft c that horizontally or vertically supports the gear shaft and the shuttle body b is inserted inside the gear shaft a. Then, the outer shuttle having the gear shaft and the shuttle body b rotates about the supporting shaft c. This is the structure of a general shuttle device. The outer shuttle rotates at a very high speed. Thus, if the sewing machine is operated for a long period, a large amount of heat is generated by the driving of the gear shaft b. With this heat, thermal expansion occurs in the gear shaft b.

However, since the gear shaft a is fixed by press-fitting to the lower surface side of the bottom portion of the shuttle body b, deformation toward the outer side in the radial direction due to thermal expansion is restricted at this press-fitting position. Thus, deformation of the gear shaft a due to thermal expansion develops toward the center in the radial direction of the shaft hole.

When the deformation of the gear shaft a due to thermal expansion develops toward the center in the radial direction of the shaft hole, the shaft hole of the gear shaft a is deformed to make strong contact with the supporting shaft c accommodated in the gear shaft a (see FIG. 4B). When such a state is created, the shuttle body as well as the gear shaft may not be able to rotate properly. Thus, the outer shuttle may be unable to perform its role satisfactorily, which may interfere with the stitching operation of the sewing machine.

Under these circumstances, an object of the present invention is to provide an outer shuttle of a sewing machine, having such a structure that a gear shaft having a shaft support hole formed on an inner circumference thereof is fixed by press-fitting to a shuttle body, the outer shuttle being capable of suppressing thermal expansion of a shaft support hole corresponding to a press-fitting area of the gear shaft to maintain satisfactory rotation.

As a result of intensive studies to solve the above problems, the inventors have solved the problems by providing, as a first embodiment of the present invention, an outer shuttle of a sewing machine, which accommodates an inner shuttle that grabs an upper thread and accommodates a bobbin around which a lower thread is wound, the outer shuttle including: a gear shaft which has a driven gear connected to a driving gear, provided on a lower shaft, which is a driving source of the outer shuttle that is rotatably supported in the sewing machine, and which also has a shaft support hole formed aligned with an axial center of the driven gear; a shuttle body to which the gear shaft is press-fitted and fixed at the center of rotation of a press-fit receiving hole formed in a bottom portion thereof; and a shuttle support shaft which is inserted into the shaft support hole of the gear shaft of the shuttle body to support the rotation of the shuttle body, wherein a plurality of ridge-shaped portions is formed on an inner circumference of the shaft support hole so as to correspond to a press-fitting depth of the gear shaft.

A second embodiment of the present invention solves the problems by the outer shuttle of the sewing machine according to the first embodiment, in which the ridge-shaped portions are formed along an axial direction of the shaft support hole at equal intervals in a circumferential direction. A third embodiment of the present invention solves the problems by the outer shuttle of the sewing machine according to the first embodiment, in which the ridge-shaped portions are formed in the shaft support hole in a spiral form.

A fourth embodiment of the present invention solves the problems by the outer shuttle of the sewing machine according to the first or second embodiment, in which the ridge-shaped portion has a cross-section in the shape of a circular arc that protrudes toward the center in a radial direction of the shaft support hole. A fifth embodiment of the present invention solves the problems by the outer shuttle of the sewing machine according to the first embodiment, in which a diameter at a distal end of the ridge-shaped portion is set to be equal to or larger than an inner diameter of the shaft support hole of the gear shaft.

In the present invention, the distal end of the gear shaft having the shaft support hole is fixed by press-fitting to the press-fit receiving hole of the shuttle body, and the plurality of ridge-shaped portions is formed on the inner circumference side corresponding to the press-fitting area of the gear shaft. Thus, even when the gear shaft and the shuttle body rotate at a high speed for a long period and thermal expansion occurs, the expanding portion of the gear shaft due to the thermal expansion can expand to the groove-shaped portions between the ridge-shaped portions.

Moreover, since a plurality of ridge-shaped portions is formed in the inner circumference corresponding to the press-fitting area of the shaft support hole of the gear shaft, the expanding portion can expand to the groove-shaped portions between the ridge-shaped portions and the shape of the shaft support hole is not damaged. Thus, the gear shaft and the shuttle body can maintain satisfactory rotation. The present invention is particularly favourable when the shuttle body is formed of metal and the gear shaft is formed of a synthetic resin which are likely to expand thermally.

DESCRIPTION OF THE PREFERRED EMBODIMENTS

Figure 1A:
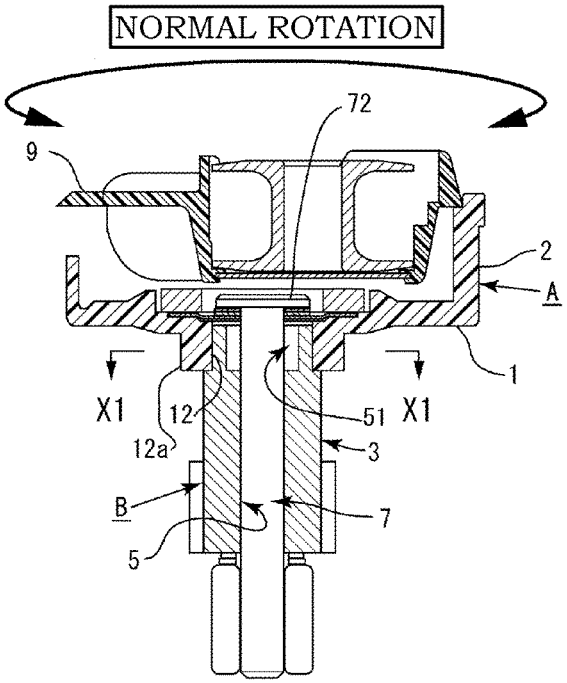
FIG. 1A is a longitudinal sectional view of a first embodiment of the present invention.
Figure 1B:
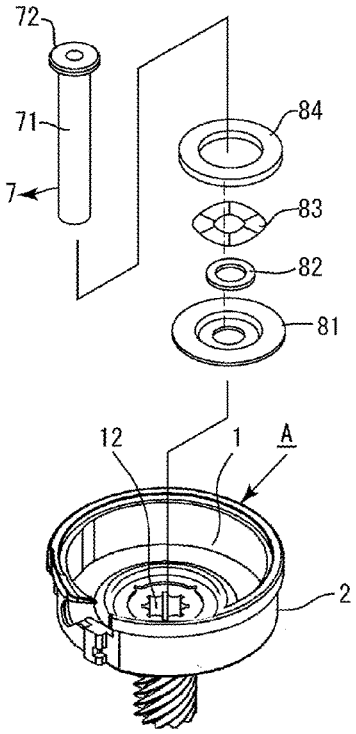
FIG. 1B is an exploded perspective view of main parts.

Embodiments of the present invention will be described with reference to the drawings. A shuttle device of the present invention mainly includes a shuttle body A, a gear shaft B, and a shuttle supporting shaft 7 as illustrated in FIGS. 1A, 1B, and the like. The shuttle body A is formed of metal or a synthetic resin such as plastics. A columnar side wall portion 2 is formed on an outer circumference of a substantially disc-shaped bottom portion 1. A shaft support hole 5 is formed at a central position of the bottom portion 1. Moreover, reference numeral 9 in the figure is an inner shuttle.

Figure 1C:
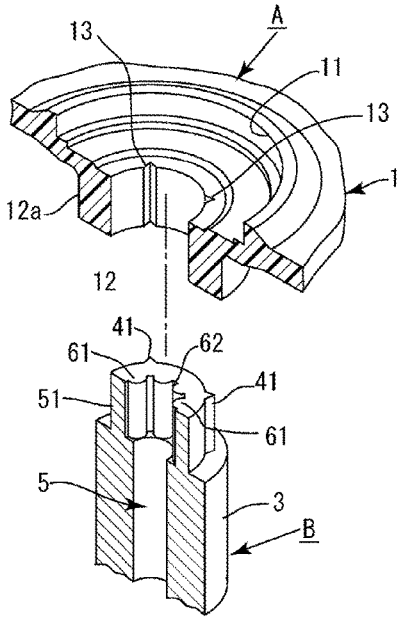
FIG. 1C is a partially cut-away, enlarged, exploded perspective view of main parts, illustrating a state in which a press-fit receiving hole of a shuttle body is separated from a distal end press-fitting portion of a gear shaft.

An accommodation groove 11 to which a magnet plate is attached is formed in an inner bottom surface of the bottom portion 1 (see FIGS. 1A, 1C, and the like). The accommodation groove 11 is a portion of the bottom portion 1 and is included in a portion of the bottom portion 1.

Figure 1D:
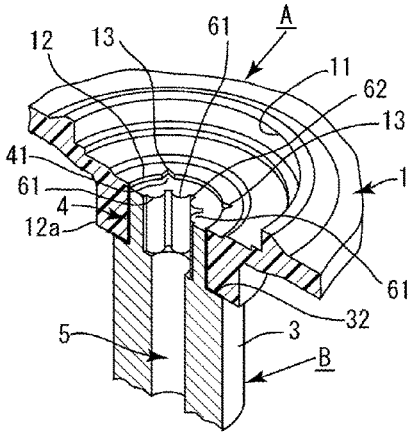
FIG. 1D is a partially cut-away, enlarged, exploded perspective view of main parts, illustrating a state in which the press-fit receiving hole of the shuttle body is press-fitted to a distal end press-fitting portion of the gear shaft.

A press-fit receiving hole 12 is formed at the center of the bottom portion 1 (see FIGS. 1B to 1D). A cylindrical portion 12*a* that extends downward is formed on a lower surface side of the bottom portion 1 and around the press-fit receiving hole 12. Engagement portions 13 are formed on the inner circumference of the press-fit receiving hole 12. The engagement portions 13 are portions that engage with engaged portions formed on a distal end press-fitting portion of the gear shaft.

The accommodation groove 11 accommodates a magnet bed 81, a washer 82, a spring washer 83, and a permanent magnet 84. The magnet bed 81 is fixed to the accommodation groove 11 and the permanent magnet 84 is fixed to the bottom portion 1 with the magnet bed 81 interposed. The gear shaft B includes a shaft body 3, a distal end press-fitting portion 4, a shaft support hole 5, and a press-fitting hole 51 (see FIGS. 1A and 1C). A driven gear 31 is provided in the shaft body 3.

The driving gear driven by a motor that is provided on the body side of a sewing machine transmits rotation via the driven gear 31 to rotate the gear shaft B. The distal end press-fitting portion 4 is formed in the distal end of the shaft body 3 and is press-fitted into the press-fit receiving hole 12 of the shuttle body A (see FIG. 1C). The distal end press-fitting portion 4 has a cylindrical shape and is formed continuously with the distal end of the shaft body 3.

The distal end press-fitting portion 4 has a smaller diameter than that of the shaft body 3 so that a step 32 is formed between the distal end press-fitting portion 4 and the shaft body 3 (see FIG. 1C). The step 32 has a role of restricting a press-fitting depth when the distal end press-fitting portion 4 of the gear shaft B is press-fitted into the press-fit receiving hole 12 and makes the press-fitting depth of the gear shaft B into the press-fit receiving hole 12 uniform.

Engaging portions 41 are formed on the outer circumference of the distal end press-fitting portion 4. The engaging portions 41 engage with the engagement portions 13 formed on the press-fit receiving hole 12 to reinforce a press-fitting structure of the distal end press-fitting portion 4 and the press-fit receiving hole 12 and prevent idle rotation. Further, although plural engagement portions 13 and plural engaging portions 41 are formed, only one engagement portion and only one engaging portion may be formed.

A shaft support hole 5 is formed along an axial direction of the shaft body 3. Moreover, a press-fitting hole 51 is formed on the inner circumference side of the distal end press-fitting portion 4 (see FIGS. 1A and 1C). The press-fitting hole 51 is formed as a portion of the shaft support hole 5 and is positioned near the upper end of the shaft support hole 5 (see FIGS. 1A and 1C). The press-fitting hole 51 is formed so as to correspond to the press-fitting depth when the distal end press-fitting portion 4 of the gear shaft B is press-fitted into the press-fit receiving hole 12 of the shuttle body A.

A plurality of ridge-shaped portions 61 is formed on the inner circumferential surface of the press-fitting hole 51 (see FIGS. 1C, 1D, and the like). The ridge-shaped portions 61 have a plurality of embodiments. As described above, the ridge-shaped portions 61 formed in the press-fitting hole 51 are also formed so as to correspond to the press-fitting depth when the distal end press-fitting portion 4 of the gear shaft B is press-fitted into the press-fit receiving hole 12 of the shuttle body A. A shuttle supporting shaft 7 (described later) is inserted in and supported by the shaft support hole 5 of the gear shaft B. The inner diameter of the shaft support hole 5 is set such that the shuttle body A can smoothly rotate around the shuttle supporting shaft 7 without any rattling.

Figure 2:
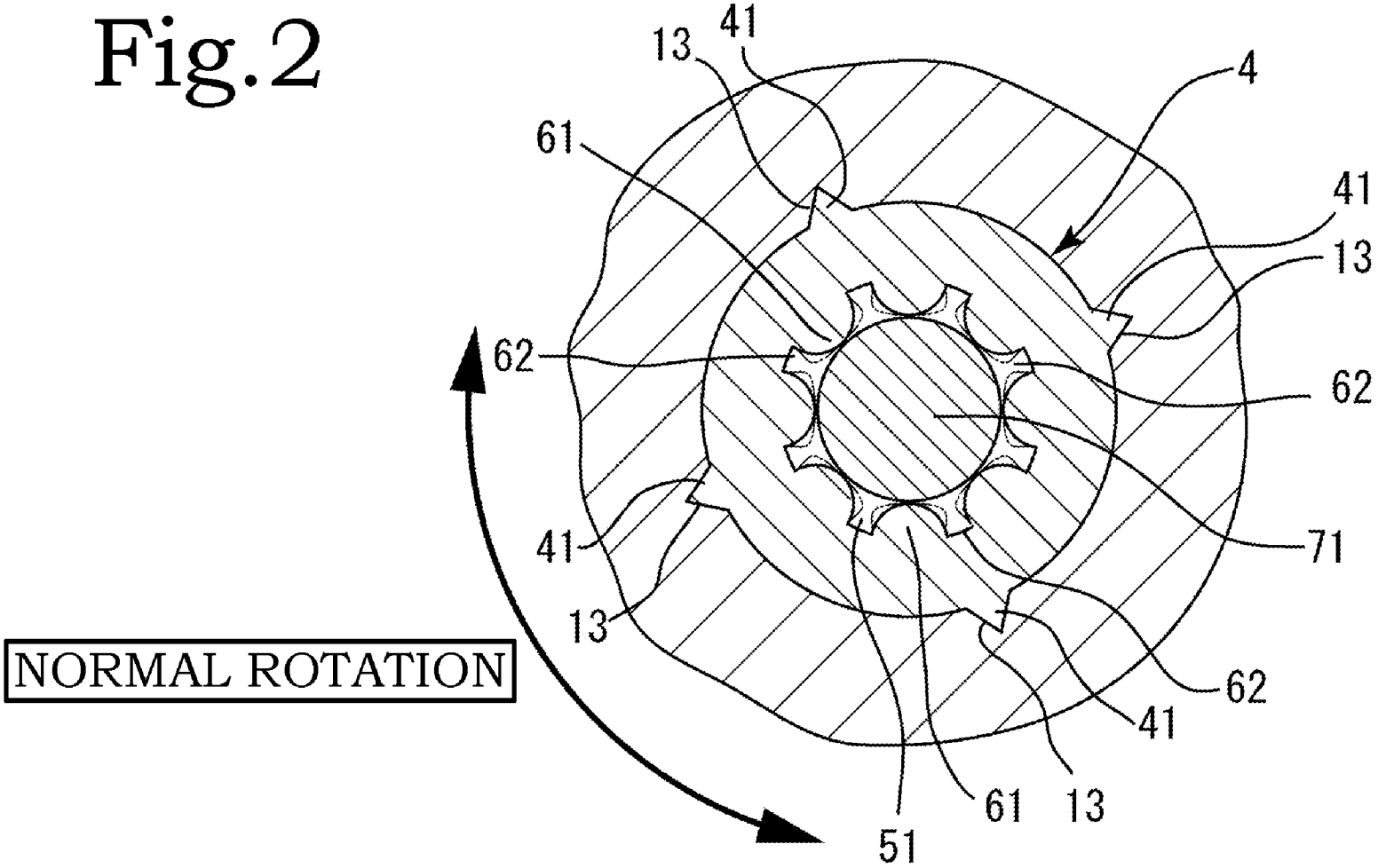
FIG. 2 is an enlarged cross-sectional plan view of main parts of a press-fitting portion in which thermal expansion has occurred.

In the press-fitting hole 51, the diameter at the distal end of the ridge-shaped portions 61 is set to be equal to or larger than the inner diameter of the shaft support hole 5. Thus, the ridge-shaped portions 61 are not in contact with the shuttle supporting shaft 7 (see FIG. 2). Thus, even when the ridge-shaped portions 61 are deformed in a radial direction due to thermal expansion, the ridge-shaped portions 61 will not make direct contact with the shuttle supporting shaft 7 and will not affect the rotation of the shuttle body A.

According to a first embodiment of the ridge-shaped portions 61, the ridge-shaped portions are formed along the axial direction at equal intervals in the circumferential direction. In this embodiment, the number of ridge-shaped portions 61 is eight. However, the number of ridge-shaped portions 61 is not limited to eight but may be smaller than or larger than eight. That is, it is sufficient that the plurality of ridge-shaped portions 61 makes uniform contact with the shuttle supporting shaft 7 in the circumferential direction and create a stable supporting state.

Figure 3B:
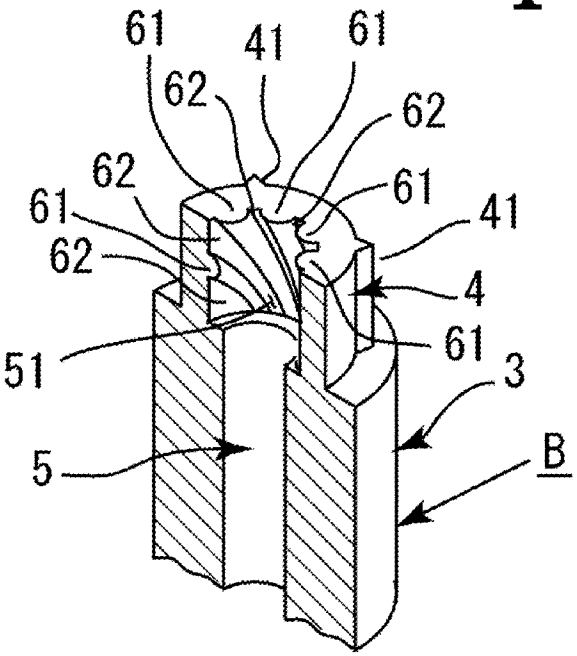
FIG. 3B is a partially cut-away perspective view of main parts, illustrating a modified example of a ridge-shaped portion according to a second embodiment.
Figure 3A:
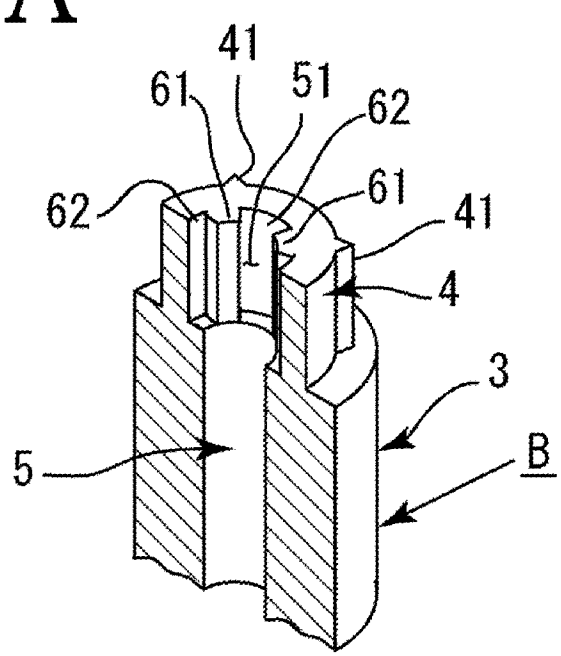
FIG. 3A is a partially cut-away perspective view of main parts, illustrating a modified example of a ridge-shaped portion according to the first embodiment.
Figure 4B:
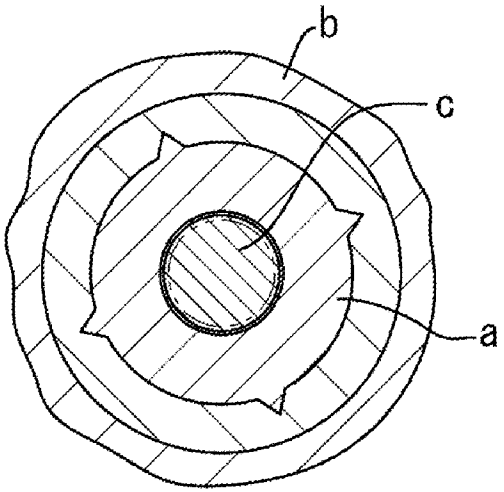
FIG. 4B is a cross-sectional plan view of main parts of the conventional technique.
Figure 4A:
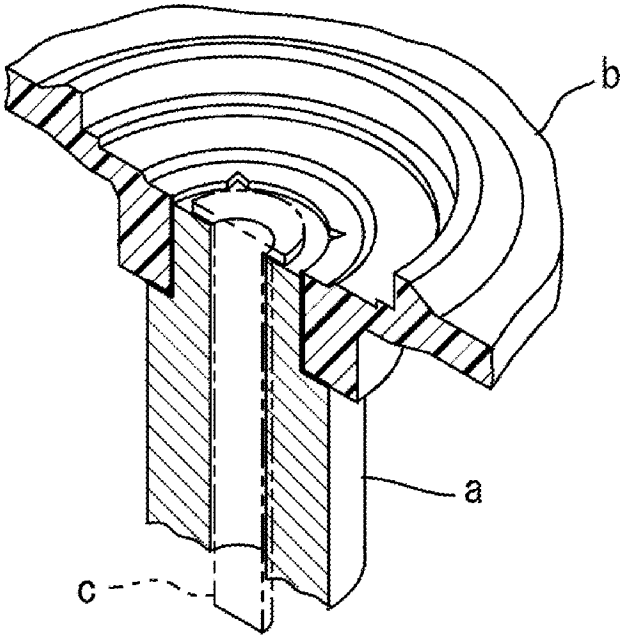
FIG. 4A is a partially cut-away perspective view of main parts according to the conventional technique.

According to a second embodiment of the ridge-shaped portions 61, a plurality of ridge-shaped portions 61 is formed in a spiral form on the inner circumferential surface of the press-fitting hole 51 (see FIG. 3B). The plurality of ridge-shaped portions 61 formed in the spiral form is formed in a substantially internal thread form. Moreover, groove-shaped portions 62 are also formed in a spiral form.

A distal end of each ridge-shaped portion 61 in the radial direction of the press-fitting hole 51 has a cross-section in the shape of a circular arc that protrudes toward the center in the radial direction of the press-fitting hole 51. Due to this, the shuttle supporting shaft 7 is supported in the press-fitting hole 51 in a substantially linearly contacting state. Moreover, the distal ends of the ridge-shaped portions 61 may have the same surface shape as an inner circumferential surface other than the press-fitting area (that is, the inner circumferential surface of the shaft support hole 5). In this case, the plurality of ridge-shaped portions 61 almost make surface contact with the outer circumference of the shuttle supporting shaft 7.

The shuttle supporting shaft 7 includes a supporting shaft portion 71 and a flange portion 72. The attachment direction of the shuttle supporting shaft 7 is determined among vertical and horizontal depending on whether the outer shuttle rotates on a horizontal surface or on a vertical surface. The supporting shaft portion 71 is inserted into the press-fit receiving hole 12 of the shuttle body A and the press-fitting hole 51 and the shaft support hole 5 of the gear shaft B, and the flange portion 72 is disposed in the accommodation groove 11 of the shuttle body A.

In the present invention, in a structure in which the distal end press-fitting portion 4 of the gear shaft B is press-fitted and fixed to the press-fit receiving hole 12 of the shuttle body A, a plurality of ridge-shaped portions 61 is formed on the inner circumference side of the press-fitting hole 51 corresponding to the press-fitting area of the distal end press-fitting portion 4 and the press-fit receiving hole 12. Even when the gear shaft B and the shuttle body A rotate at a high speed for a long period and thermal expansion occurs, the expanding portion due to the thermal expansion in the press-fitting portion can expand to the plurality of groove-shaped portions 62 formed between the plurality of ridge-shaped portions 61 (see FIG. 2).

That is, the outer circumferential portion of the distal end press-fitting portion 4 of the gear shaft B is surrounded by the press-fit receiving hole 12. Thus, the distal end press-fitting portion 4 of the gear shaft B cannot expand toward the outer side in the radial direction. Therefore, the distal end press-fitting portion 4 thermally expands toward the center in the radial direction from the inner circumference side.

In this state, on the inner circumference side of the distal end press-fitting portion 4, the protruding portion due to thermal expansion presses the outer circumference of the shuttle supporting shaft 7 so that the shuttle body A and the gear shaft B cannot rotate properly. However, since the press-fitting hole 51 has the plurality of ridge-shaped portions 61, the portions that protrude due to thermal expansion can expand to the plurality of groove-shaped portions 62 formed between the plurality of ridge-shaped portions 61 (see FIG. 2).

Due to this, even when thermal expansion occurs in the gear shaft B, the shape of the press-fitting hole 51 is rarely damaged, and the press-fitting hole 51 of the gear shaft B can maintain satisfactory rotation of the shuttle body A and the gear shaft B without pressing the outer circumference of the shuttle supporting shaft 7. The present invention is particularly favourable when the gear shaft B is formed of synthetic resins and the shuttle body A is formed of metal.

According to the second embodiment, since the ridge-shaped portions are formed along the axial center of the shaft support hole at equal intervals in the circumferential direction, it is possible to simplify the structure. According to the third embodiment, since the ridge-shaped portions are formed in the shaft support hole in a spiral form, it is possible to increase the effective length of each ridge-shaped portion and to increase the expanding portion due to thermal expansion.

According to the fourth embodiment, since the ridge-shaped portion has a cross-section in the shape of a circular arc that protrudes toward the center in the radial direction of the distal end shaft supporting portion, it is possible to decrease the contacting area of the ridge-shaped portion and the supporting shaft and to decrease the rotation resistance between the gear shaft and the supporting shaft. According to the fifth embodiment, since the adjacent ridge-shaped portions are at the same surface as an inner circumferential surface other than a press-fitting area, it is possible to allow the supporting shaft to make uniform contact with the shaft support hole of the gear shaft.

The invention claimed is:

1. An outer shuttle of a sewing machine, which accommodates an inner shuttle that grabs an upper thread and accommodates a bobbin around which a lower thread is wound, the outer shuttle comprising:

a gear shaft which has a driven gear connected to a driving gear, provided on a lower shaft, which is a driving source of the outer shuttle that is rotatably supported in the sewing machine, and which also has a shaft support hole formed aligned with an axial center of the driven gear;

a shuttle body to which the gear shaft is press-fitted and fixed at the center of rotation of a press-fit receiving hole formed in a bottom portion thereof; and a shuttle supporting shaft which is inserted into and therethrough the shaft support hole of the gear shaft of the shuttle body to support rotation of the shuttle body, wherein a plurality of ridge-shaped portions is formed on an inner circumference of the shaft support hole so as to correspond to a press-fitting depth of the gear shaft.

2. The outer shuttle of a sewing machine according to claim 1, wherein the ridge-shaped portions are formed along an axial direction of the shaft support hole at equal intervals in a circumferential direction.

3. The outer shuttle of a sewing machine according to claim 1, wherein the ridge-shaped portions are formed in the shaft support hole in a spiral form.

4. The outer shuttle of a sewing machine according to claim 1, wherein the ridge-shaped portions have a cross-section in a shape of a circular arc that protrudes toward the center in a radial direction of the shaft support hole.

5. The outer shuttle of a sewing machine according to claim 1, wherein a diameter at a distal end of the ridge-shaped portions is set to be equal to or larger than an inner diameter of the shaft support hole of the gear shaft.

6. The outer shuttle of a sewing machine according to claim 2, wherein the ridge-shaped portions have a cross-section in a shape of a circular arc that protrudes toward the center in a radial direction of the shaft support hole.

7. The outer shuttle of a sewing machine according to claim 1, wherein a press-fitting hole is formed as a portion of the shaft support hole and is positioned near an upper end of the shaft support hole.

8. The outer shuttle of a sewing machine according to claim 1, wherein plurality of the ridge-shaped portions are not in contact with the shuttle supporting shaft.

* * * * *